US009920587B2

(12) United States Patent
Henderson et al.

(10) Patent No.: US 9,920,587 B2
(45) Date of Patent: Mar. 20, 2018

(54) TESTABLE ISOLATION PACKER

(71) Applicant: HALLIBURTON ENERGY SERVICES, INC., Houston, TX (US)

(72) Inventors: William David Henderson, Tioga, TX (US); Timothy Edward Harms, The Colony, TX (US); William Mark Richards, Flower Mound, TX (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 64 days.

(21) Appl. No.: 14/408,394

(22) PCT Filed: Jan. 23, 2014

(86) PCT No.: PCT/US2014/012715
§ 371 (c)(1),
(2) Date: Dec. 16, 2014

(87) PCT Pub. No.: WO2015/112145
PCT Pub. Date: Jul. 30, 2015

(65) Prior Publication Data

US 2016/0010421 A1 Jan. 14, 2016

(51) Int. Cl.
*E21B 33/12* (2006.01)
*E21B 33/124* (2006.01)
(Continued)

(52) U.S. Cl.
CPC ..... *E21B 33/124* (2013.01); *E21B 33/129* (2013.01); *E21B 33/1285* (2013.01);
(Continued)

(58) Field of Classification Search
CPC .. E21B 33/124; E21B 33/1243; E21B 33/129; E21B 33/1291; E21B 33/1294; E21B 33/1285; E21B 33/1295
See application file for complete search history.

(56) References Cited

U.S. PATENT DOCUMENTS 5,803,186 A * 9/1998 Berger ..... E21B 21/103 166/250.17
2002/0100585 A1 8/2002 Spiers et al.
(Continued)

FOREIGN PATENT DOCUMENTS

EP 0497588 8/1992

OTHER PUBLICATIONS

Superior Energy Services "Completion Services Catalog" TIP Packer, 2 pages.
(Continued)

*Primary Examiner* — Waseem Moorad
*Assistant Examiner* — Christopher Sebesta
(74) *Attorney, Agent, or Firm* — Kilpatrick Townsend & Stockton LLP

(57) ABSTRACT

Certain aspects are directed to a testable isolation packer that sets and provides the ability to test upper and lower packer elements. In one aspect, the testable isolation packer includes at least two packer elements, a packer element setting system, a bypass system, and a testing subassembly. The testing subassembly generally includes a moveable element with an outer port and a sealing element, an inner mandrel with an inner port, and a shear mechanism to cause travel of the moveable element close the bypass system and to open the testing subassembly.

12 Claims, 10 Drawing Sheets

(51) Int. Cl.
*E21B 33/128* (2006.01)
*E21B 33/1295* (2006.01)
*E21B 33/129* (2006.01)

(52) U.S. Cl.
CPC ..... *E21B 33/1295* (2013.01); *E21B 33/1291* (2013.01); *E21B 33/1294* (2013.01)

(56) References Cited

U.S. PATENT DOCUMENTS

2002/0148607 A1 10/2002 Pabst
2002/0178804 A1* 12/2002 Manke ..... E21B 33/124 73/152.55
2004/0084190 A1* 5/2004 Hill ..... E21B 23/006 166/386
2005/0205302 A1 9/2005 Meister et al.
2006/0248949 A1* 11/2006 Gregory ..... E21B 49/088 73/152.51
2008/0066535 A1 3/2008 Vasques et al.
2009/0056952 A1* 3/2009 Churchill ..... E21B 21/10 166/373
2009/0183882 A1* 7/2009 van Zuilekom .... E21B 33/1243 166/371
2011/0139465 A1* 6/2011 Tibbles ..... E21B 33/124 166/387
2011/0284227 A1* 11/2011 Ayan ..... E21B 43/16 166/307
2012/0150515 A1* 6/2012 Hariharan ..... E21B 33/124 703/7
2012/0160521 A1* 6/2012 McGlothen ..... E21B 33/1285 166/387

OTHER PUBLICATIONS

International Patent Application No. PCT/US2014/012715 , International Search Report and Written Opinion dated Oct. 27, 2014, 12 pages.

* cited by examiner 10
49
66
46
58
48
34
32
50
56
16

49
66
46
48
34
32
50
56

54
49
66
46
48
34
32
50
56

TESTABLE ISOLATION PACKER

CROSS-REFERENCE TO RELATED APPLICATIONS

This is a U.S. national phase under 35 U.S.C. 371 of International Patent Application No. PCT/US2014/012715, titled "Testable Isolation Packer" and filed Jan. 23, 2014, the entirety of which is incorporated herein by reference.

TECHNICAL FIELD OF THE DISCLOSURE

The present disclosure relates generally to devices for use in a wellbore in a subterranean formation and, more particularly (although not necessarily exclusively), to a testable isolation packer that may be used for testing packer elements in a downhole configuration.

BACKGROUND

Various devices can be utilized in a well that traverses a hydrocarbon-bearing subterranean formation. In many instances, it may be desirable to divide a subterranean formation into zones and to isolate those zones from one another in order to prevent cross-flow of fluids from the rock formation and other areas into the annulus. It may also be desirable to control sand across multi-zone applications. Packers may be set in the well in order to isolate zones so that the zones may be gravel packed and produced separately. Without such devices, the zone may experience problems such as sand production, erosion, water breakthrough, or other detrimental problems. A packer may be set between zones in order to seal them from one another.

A well packer may be run into the well on a completion string. Once deployed, packer elements support the completion string and other completion equipment, as well as seal the annulus. For example, a packer may be used to support a screen adjacent to a producing formation and to seal the annulus between the outside of the completion string and the inside of the wellbore casing. This blocks movement of fluids through the annulus past the packer. A packer device may be deployed along the completion string in the wellbore by applying a force to an elastomeric element of the packer. The elastomeric element of the packer may be the portion that creates an annular seal between the completion string and the wellbore casing. The packer device may also have a wedge/slip system that may be engaged to help hold the completion string in place.

Isolation packers are typically run into a well with sand screens or perforated tubing separating each packer. In a multi-zone gravel pack completion, the packers and sand screens are run into the well as a completion string. This completion string separates the well into individual zones between each packer.

The conventional installation method for a completion string with multiple isolation packers is to locate the completion string in the well and set all of the isolation packers at one time. However, using this method of installation does not allow each individual packer to be pressure tested. From the surface, there is no way to know that each of the packers has been properly set.

DETAILED DESCRIPTION

Certain aspects and examples of the present disclosure are directed to a testable isolation packer. Aspects and examples are also directed to methods for verifying that the testable isolation packer has been properly set during installation in a multi-zone well. The testable isolation packer may isolate zones in the well. It is desirable to reliably confirm that the packer elements of the testable isolation packer have been properly sealed against the wellbore casing so that the testable isolation packer can effectively isolate the desired zone.

In some implementations, the testable isolation packer can include upper and lower packer elements, a bypass system, and a testing subassembly. The upper and lower packer elements can seal an annular space between a completion string and a wellbore casing in a well system. The bypass system can include a series of ports for allowing excess fluid to exit the annular space through the packer system during setting of the packer and deployment of the packer elements. The testing subassembly can include a moveable feature that moves from a closed mode to a test mode. In the test mode, pressure can be delivered into the annular space between the packer outside diameter, casing inside diameter, and packer elements. The pressure directed to the annulus space between the packer elements is used to indicate to a well operator whether the packer elements are maintaining a constant pressure therebetween. The pressure remaining relatively constant can indicate that the packer elements have contacted the casing and completely sealed.

These illustrative examples are given to introduce the reader to the general subject matter discussed here and are not intended to limit the scope of the disclosed concepts. The following sections describe various additional aspects and examples with reference to the drawings in which like numerals indicate like elements, and directional descriptions are used to describe the illustrative aspects. The following sections use directional descriptions such as "above," "below," "up," "down," "upper," "lower," "upward," "downward," "left," "right," "uphole," "downhole," etc. in relation to the illustrative aspects as they are depicted in the figures, the upward direction being toward the top of the corresponding figure and the downward direction being toward the bottom of the corresponding figure, the uphole direction being toward the surface of the well and the downhole direction being toward the bottom of the well.

Like the illustrative aspects, the numerals and directional descriptions included in the following sections should not be used to limit the present disclosure.

Figure 1:
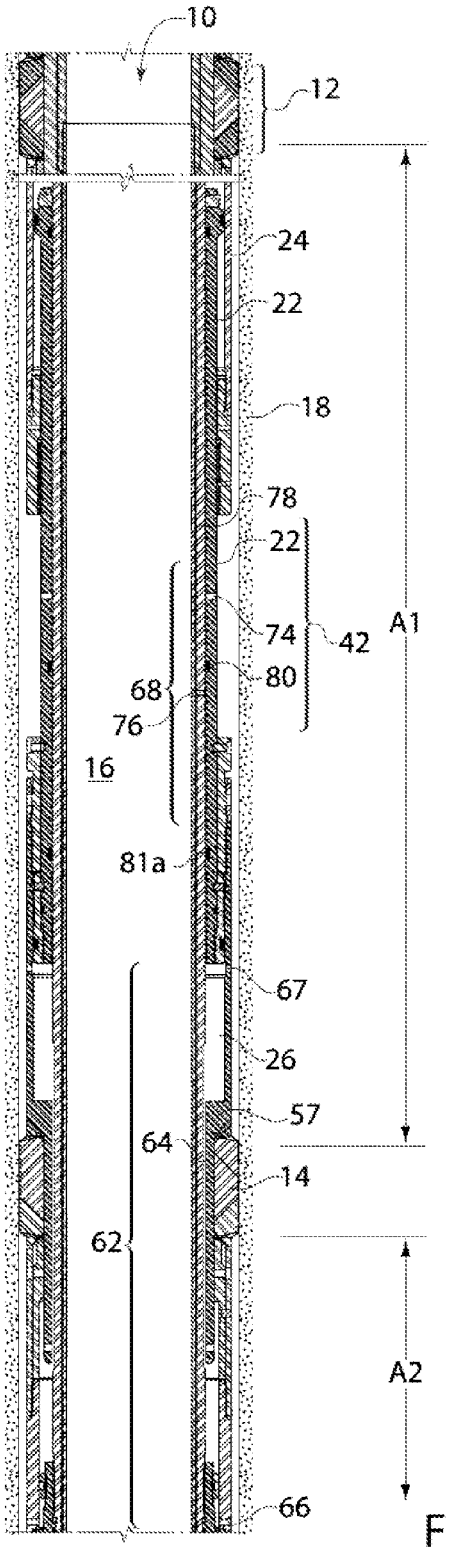
FIG. 1 shows a schematic view of a testable isolation packer located in a wellbore casing with a testing subassembly in a closed position according to one example.
Figure 2:
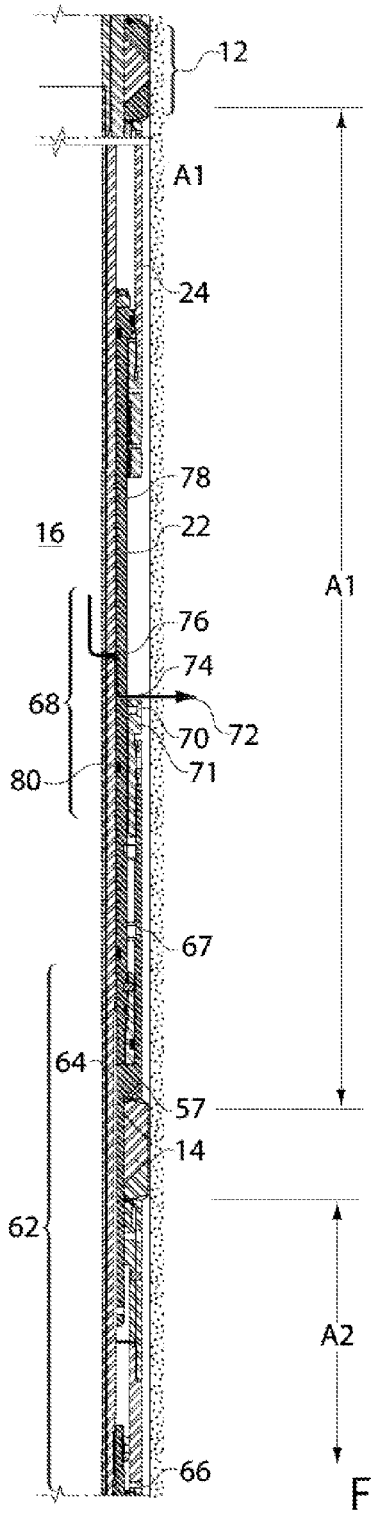
FIG. 2 shows the testable isolation packer of FIG. 1 with the testing subassembly in an open position according to one example.
Figure 4A:
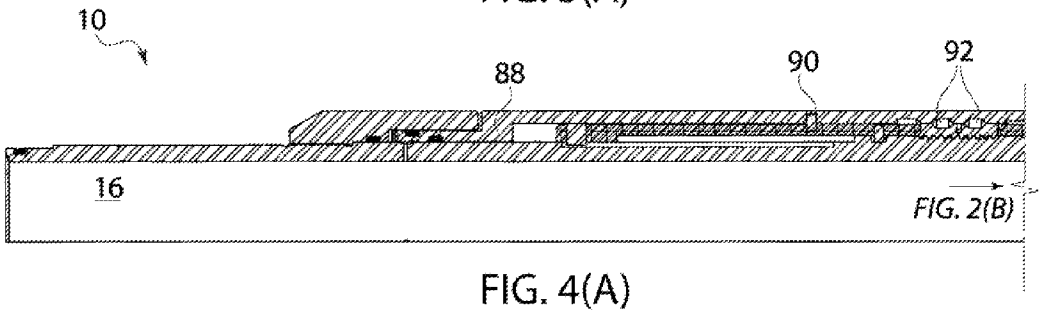
FIGS. 4A-D show cross-sectional views of a portion of the testable isolation packer of FIG. 1 in a first start to set configuration according to one example.
Figure 5A:
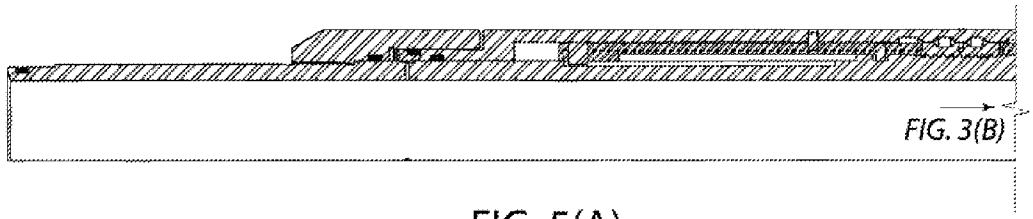
FIGS. 5A-D show cross-sectional views of a portion of the testable isolation packer FIG. 1 in a second start to set configuration according to one example.

Although more detail of certain features is provided below, FIGS. 1 and 2 provide a general overview of selected components of a testable isolation packer. These figures are simplified for ease of review and explanation and are not intended to be to scale. FIG. 1 illustrates a testable isolation packer 10 positioned in a wellbore casing 18 according to one example. The testable isolation packer 10 includes an upper packer element 12 and a lower packer element 14, a packer element setting system, a bypass system 62, and a testing subassembly 68.

Deployment of upper and lower packer elements 12, 14 can seal an annulus space A1 between an outer portion of the completion string 16 and the wellbore casing 18. This seal can block movement of fluids across the packer elements 12, 14 such that packer elements 12, 14 can seal a desired zone from other parts of the wellbore 18. Any packer element setting system may be used in connection with various features provided by this disclosure. An example of a packer element setting system is described below with reference to FIGS. 3B-3C, 4C-4C, and 5B-5C. FIGS. 1 and 2 show the upper and lower packer elements 12, 14 after they have been fully compressed to contact the wellbore casing 18.

After the packer elements 12, 14 have been fully compressed, fluid from the annulus space A1 between the packer elements 12, 14 can exit via bypass system 62. The bypass system 62 includes cooperation between a lower element port 67 in fluid communication with a chamber space 26, a channel 64, and a release port 66. Fluid may move from space A1 between the upper and lower packer elements 12, 14, through the lower element port 67, and into chamber space 26. It can be undesirable for fluid to remain blocked in chamber 26 because, for example, it may hydraulically lock a moveable element 22 associated with the testing subassembly 68.

The bypass system 62 can allow fluid to exit chamber 26 through release port 66. Fluid can flow through a release port 66, downhole of the lower packer element 14, into the annulus space A2 and exit the system. This releases any hydraulic lock that may have otherwise prevented travel of moveable element 22.

Movement of the moveable element 22 can allow activation of the testing subassembly 68 of the testable isolation packer 10. The testing subassembly 68 in a test mode can open a flow path 72 (shown in FIG. 2) that allows pressure to be delivered to the space between the packer elements. In one aspect, the testing subassembly 68 provides a closed mode and a test mode. FIG. 1 shows the testing subassembly 68 in its closed mode. FIG. 2 shows the testing subassembly 68 in its test mode.

In the test mode, opening of a flow path 72 allows pressure applied through a port to be directed to a location in the annulus space A1, between the upper and lower packer elements 12, 14. If the pressure level holds at a relatively constant level, this indicates to the operator that the packer elements have created an appropriate seal against the wellbore casing 18.

Movement of a moveable element 22 with respect to an inner mandrel 78 controls the state of the flow path 72. The inner mandrel 78 has an inner port 76. The moveable element has an outer port 74 and a sealing element 80. The sealing element 80 is positioned between the two ports 74, 76 when the moveable element 22 is in the position shown in FIG. 1, the closed mode. The sealing element 80 is positioned downhole of the inner port 76 when the moveable element 22 is in the position shown in FIG. 2, the test mode.

Movement of the moveable element 22 causes the sealing element 80 and the outer port 74 (both located on the moveable element 22 in FIG. 2) to move past the inner port 76. Movement of the sealing element 80 from a position between the ports 74, 76 (in the closed mode) to a position that is past the ports 74, 76 (in the test mode) allows fluid communication between the inner port 76 and the outer port 74. The above overview is provided for context for the additional features, their relation to one another, and their activation, which will be described below in further detail.

FIGS. 3A-D show one aspect of a testable isolation packer 10 in a configuration along a completion string 16 for being positioned in the wellbore. The completion string 16 is generally tubular in nature as reflected by FIGS. 3A-D. The remaining figures of the testable isolation packer 10 show only a portion of the tubular cross-section of the testable isolation packer 10 on the completion string 16 for ease of reference. FIGS. 4A-D show the testable isolation packer 10 in a first configuration, prior to deployment of the upper and lower packer elements. FIGS. 5A-D show the testable isolation packer 10 with a slip system 34 and the upper packer element 12 deployed. FIGS. 6A-D show the testable isolation packer 10 with the lower packer element 14 deployed and the testing subassembly 68 in the closed position. FIGS. 7A-D show the testing subassembly 68 in an open position in order to allow testing of the pressure between the upper and lower packer elements 12, 14 with the bypass closed. The figures can be laid end to end for a perspective of the components and their cooperation.

Many of the components described herein are secured to other elements via shear mechanisms. These shear mechanisms can maintain the components in secured relation until a pressure or other force is delivered to shear the shear mechanism. The shear mechanisms are configured to shear at different forces in order to ensure that the proper setting steps described are completed in order. As described in more detail below, pressure delivered through the inner mandrel, acting on a piston and a moveable element, causes the shear mechanisms to go from shear to shear in a certain order. This allows the setting process to follow the following steps: begin compression of the upper packer element, set the slip system, begin compression of the lower packer element, then simultaneously close the bypass system and open the testing subassembly. The order of the shearing of the shearing mechanisms described is generally intended to guide the order in which various elements deploy or are separated from one another.

Figure 3A:
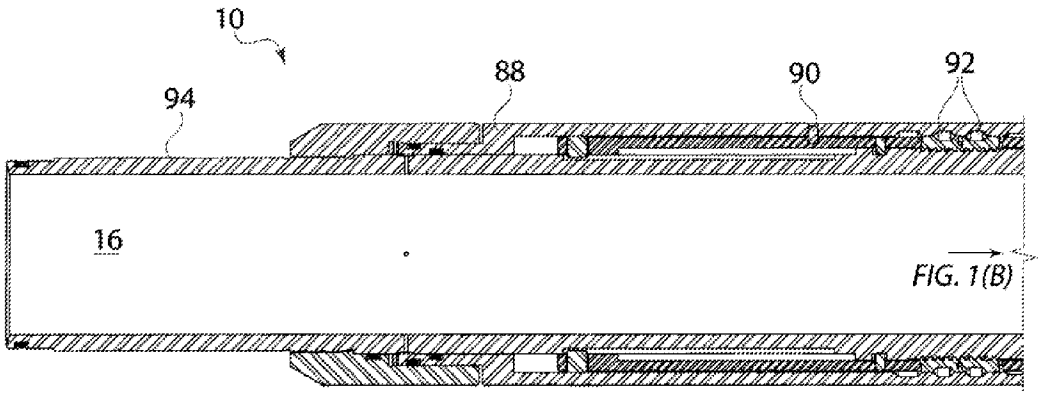
FIGS. 3A-D show cross-sectional views of one embodiment of a testable isolation packer in a run-in configuration.
Figure 3B:
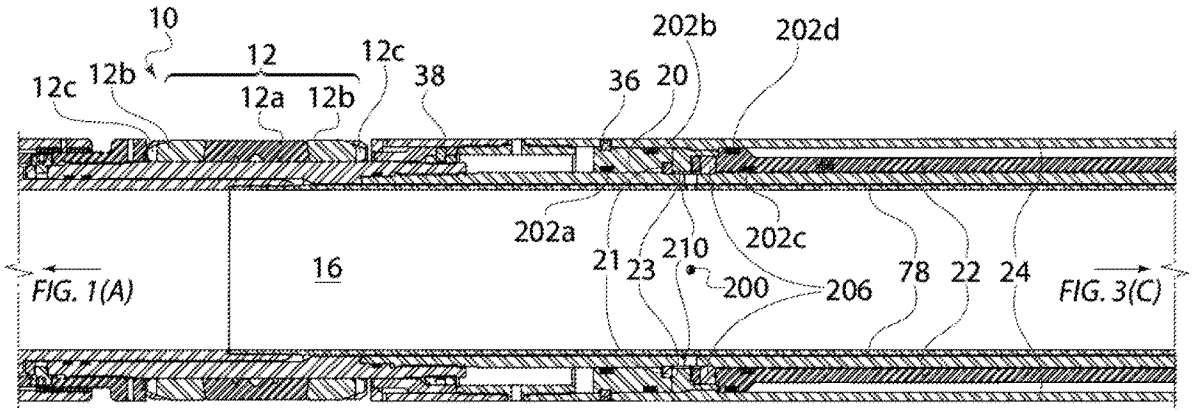
Figure 4B:
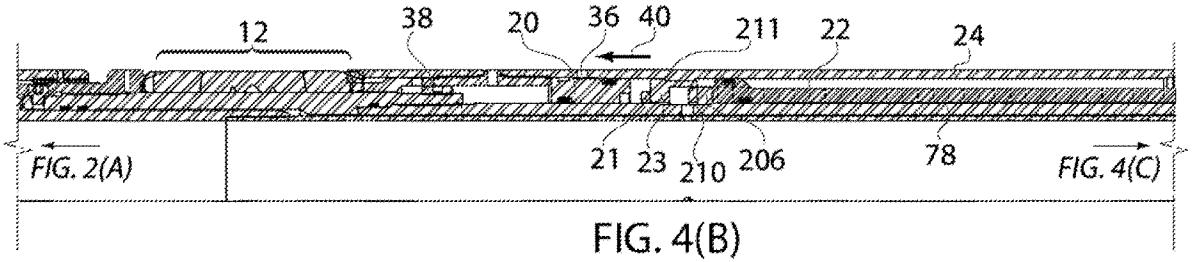
Figure 5B:
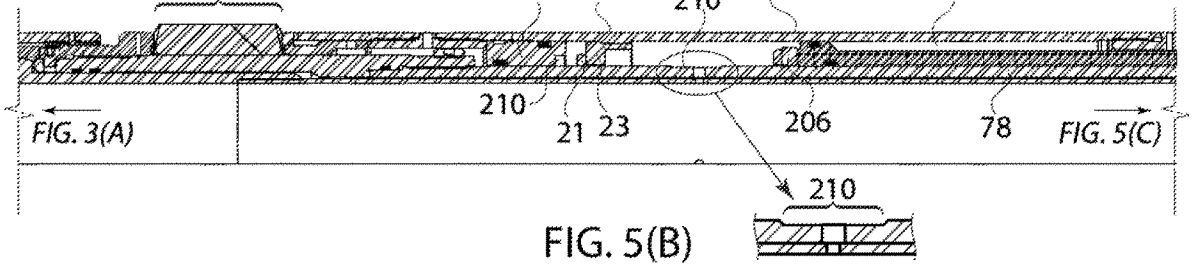
Figure 3C:
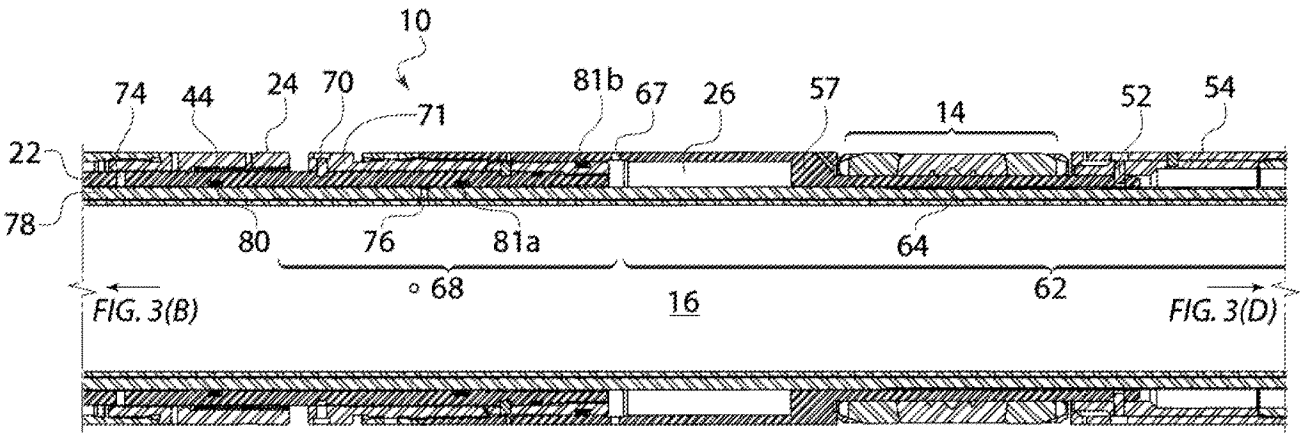
Figures 3C, 3D, 4C, 4D, 5C, 5D:
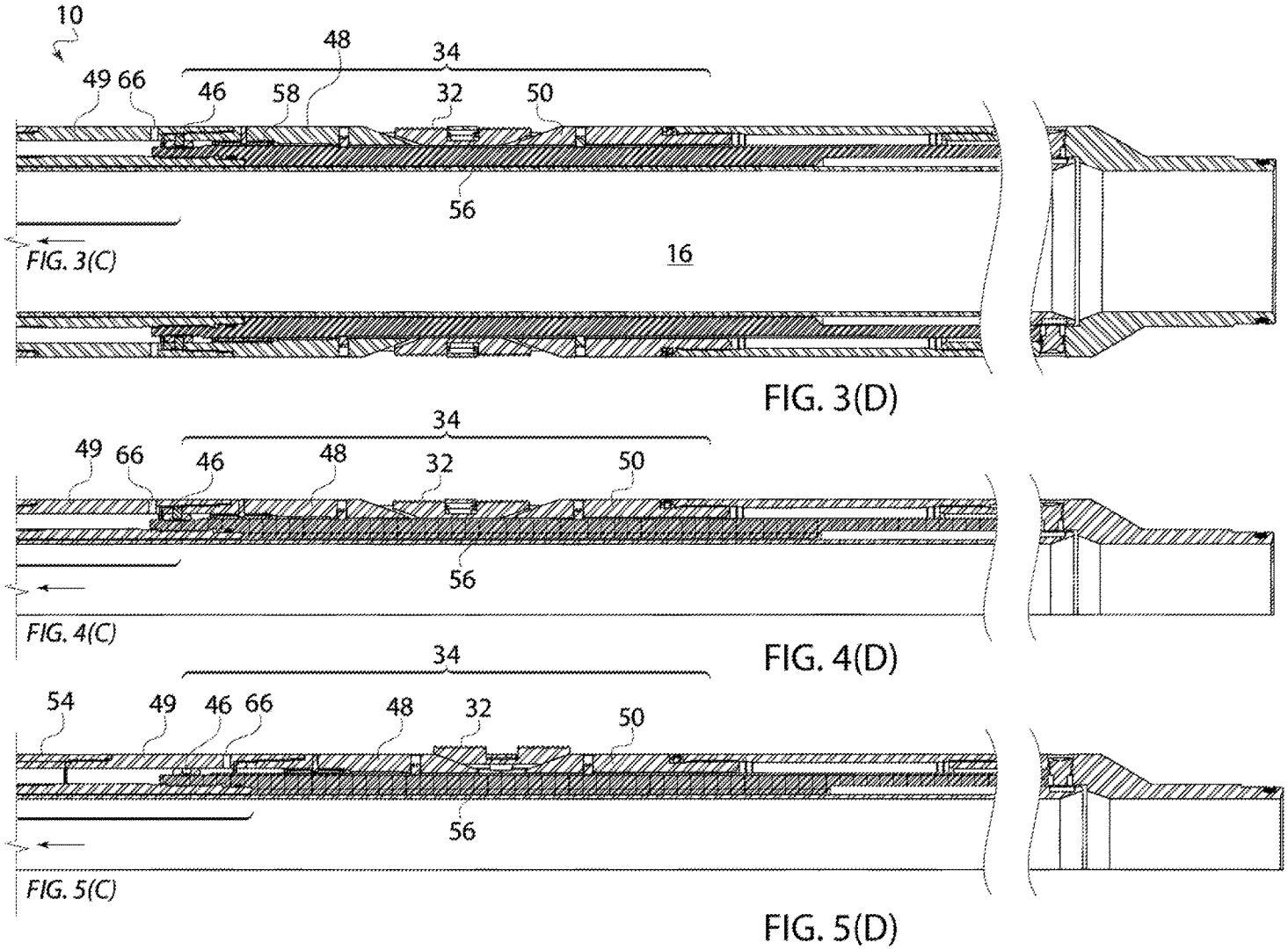
Figure 6A:
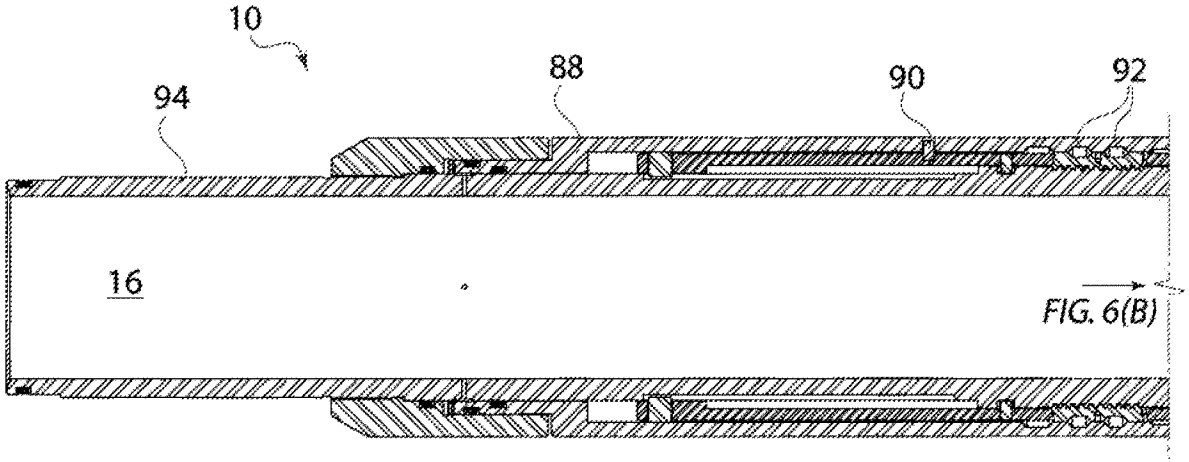
FIGS. 6A-D show cross-sectional views of a portion of the testable isolation packer of FIG. 1 with a testing subassembly in a closed position according to one example.
Figure 7A:
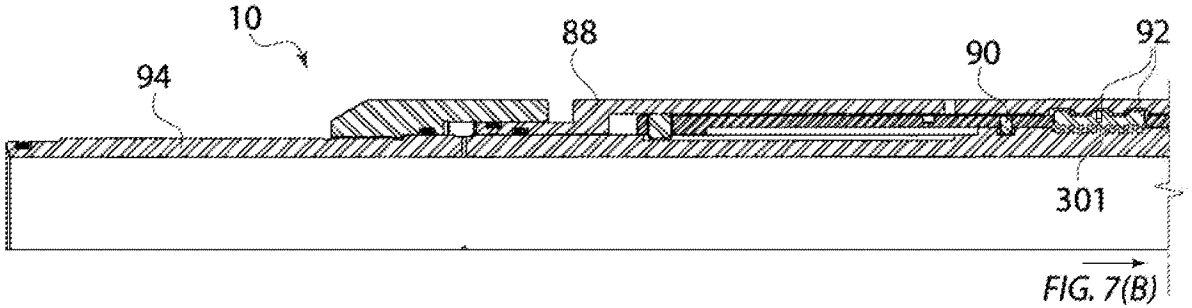
FIGS. 7A-D show cross-sectional views of a portion of the testable isolation packer of FIG. 1 with the testing subassembly in an open position according to one example.
Figure 6B:
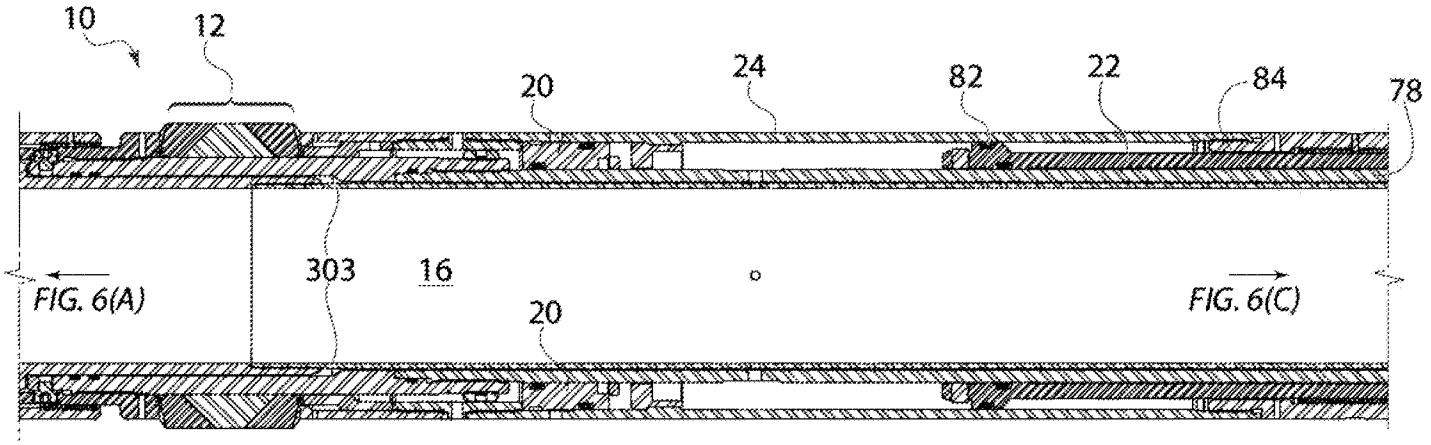
Figure 7B:
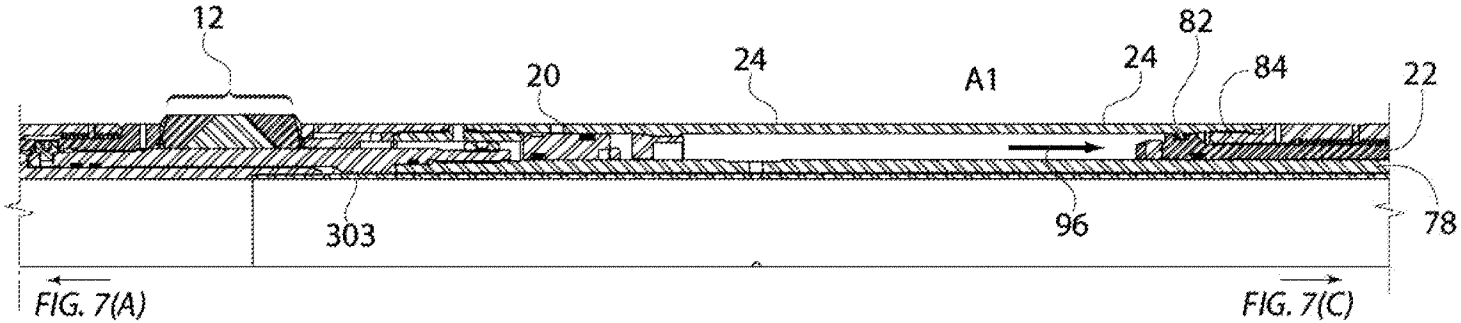
Figure 6C:
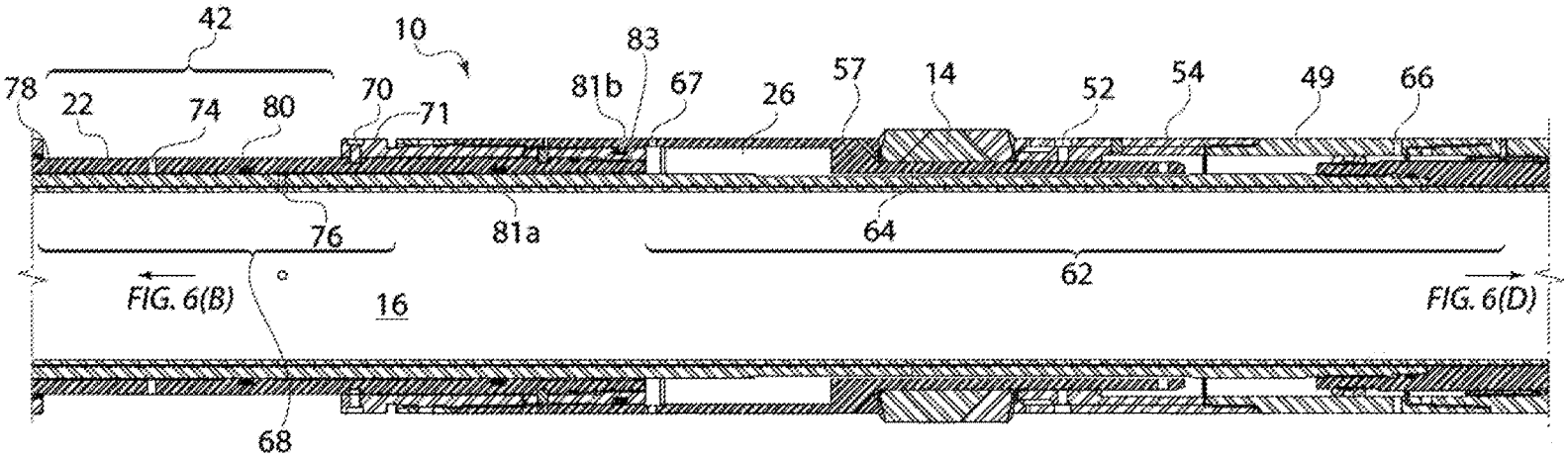
Figure 7C:
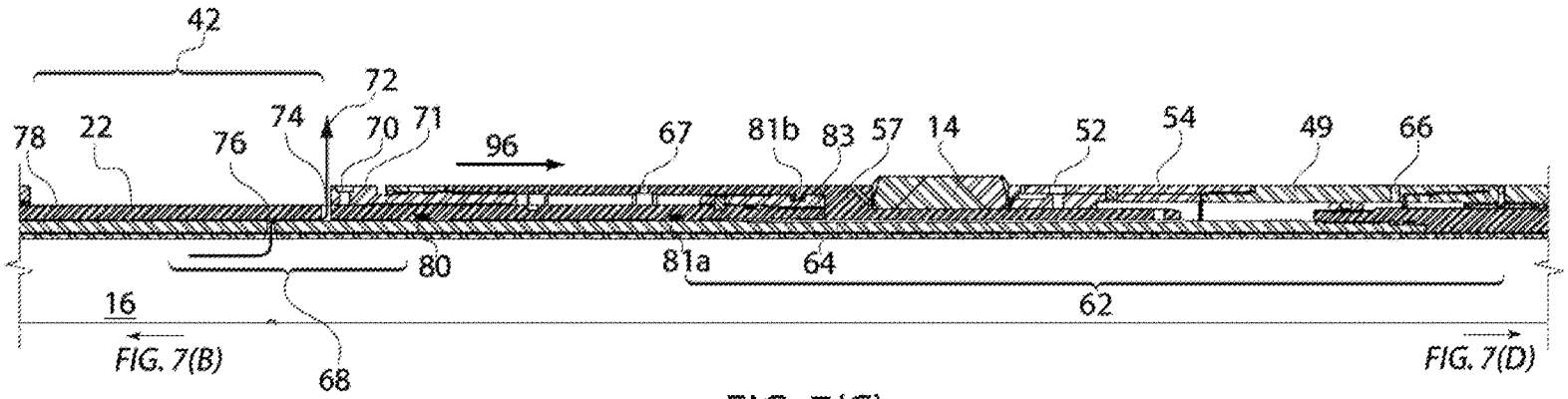

Each of these figures and the related shears and component movements will be detailed below, but the following summary is provided for perspective. The upper packer element 12, lower packer element 14, and the slip system 34 are shown in their undeployed positions in FIGS. 3B-D. In FIG. 4B, the first shear mechanism 36 and second shear mechanisms 38 have sheared. Each of these shears allows movement that creates increasing compression applied to the upper element 12 which each shear. FIG. 5D shows the third shear mechanism 46 after shear. This shear allows movement that sets the slip system 34. FIG. 6C shows the fourth shear mechanism 42 after shear. This shear allows movement that creates compression applied to the lower element 14. FIG. 7C shows the fifth shear mechanism 70 after shear. This shear allows movement of the movable element 22, which closes the bypass system 62 and opens the testing subassembly 68 so that testing of the packer elements' seal against the wellbore casing can begin.

In order to begin the packer element and slip setting process, application of tubing pressure through port 200 acts on a set of o-rings 202*a* and 202*b*. As depicted in FIG. 3B, o-rings 202*a*, 202*b*, 202*c*, and 202*d* seal a piston 20 and a moveable element 22 to the housing 24 and to the inner mandrel 78. The applied pressure produces a force against the piston 20 to shear a first shear mechanism 36. The first shear mechanism 36 (and other shear mechanisms described herein) may be a pin, screw, shear ring, or any other type of shear device without departing from the invention.

A release ring 21 is a split ring that sits in a groove 210 on the mandrel and prevents the housing 24 from moving upwards toward the upper packer element 12 until the piston 20 shears the first shear mechanism 36 and releases the release ring 21. The pressure and the shearing of the first shear mechanism 36 allows the piston 20 to move slightly in order to uncover release ring 21. Piston 20 uncovers release ring 21 which abuts a housing ring 23 that covers lugs 206. The housing ring 23 abuts shoulder 211 on housing 24. When the piston 20 uncovers the release ring 21, the release ring 21 expands out of the piston groove 210 and allows the housing ring 23 and housing 24 to travel upwards (towards element 12). Once the first shear mechanism 36 is sheared, the piston 20 is allowed to travel away from the moveable element 22, as indicated by arrow 40 on FIG. 4B.

Meanwhile, the moveable element 22 is restrained from movement by lugs 206 installed in windows in moveable element 22 and engaged in the groove 210 on the mandrel. The housing ring 23 covers the lugs 206 and prevents movement of moveable element 22.

As shown in FIG. 4B, continued pressure and movement of the piston 20 shears the second shear mechanism 38. When the second shear mechanism 38 breaks, the housing ring 23 uncovers lugs 206. The lugs 206 move in a small window milled in the moveable element 22 to disengage from groove 210 on the mandrel and release the moveable element 22. This allows movement of the moveable element toward the lower packer element 14.

The tubing pressure applied through the port 200 of the inner mandrel 78, acting of the piston 20, and mandrel 22 causes the system to go from shear to shear. Each of the described shears applies more and more compression to the upper element 12, which begins the setting process of the upper element 12. As shown in FIG. 3B, the upper element 12 may include a middle elastomer element 12*a*, end elastomer elements 12*b*, and metal back-up rings 12*c*. The upper element 12 will continue to be compressed until it contacts the wellbore casing 18. During this described process, the upper packer element is expanding, but it is not fully compressed until the below-described fifth shear.

Figure 5C:
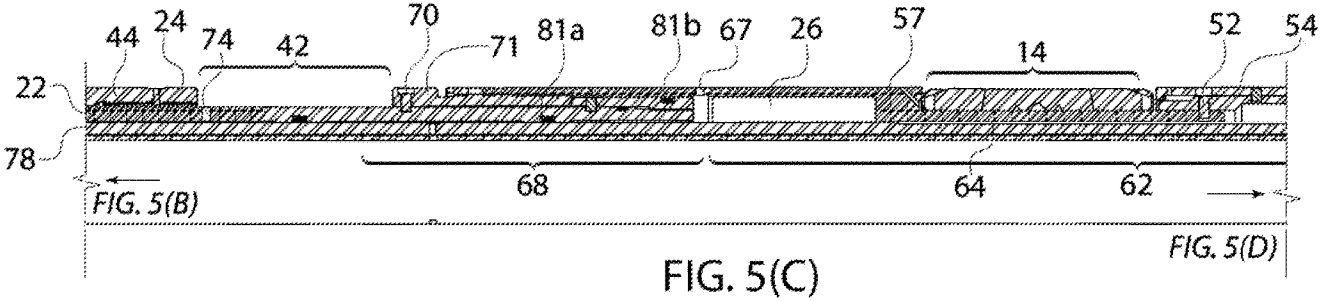

As the piston 20 and housing 24 move away from the moveable element 22 in the direction of arrow 40, a space 42 is created between the housing 24 and a testing subassembly 68 as the piston compresses the upper element 12. This space 42 is illustrated by FIG. 5C. Pressure applied through port 200 pushes the piston 20 upward toward the upper packer element 12 and pushes the movable element 22 downward toward the lower packer element 14. The housing 24 is also moved upward toward the upper packer element 12.

Figure 4C:
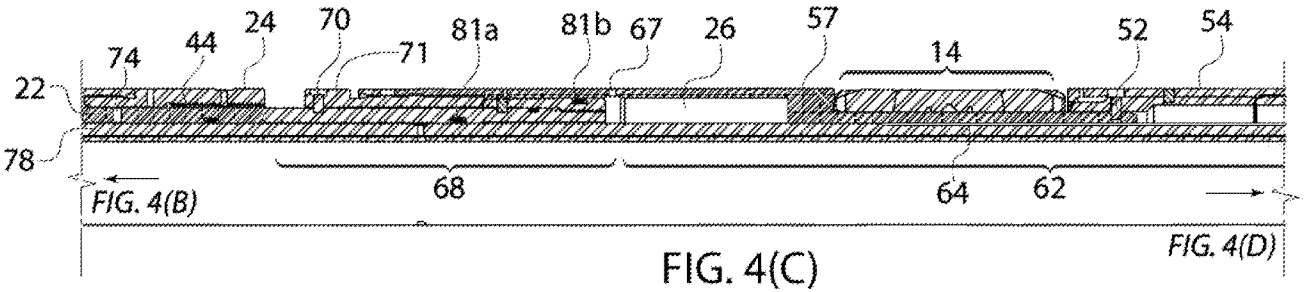

Relative movement of the housing 24 with respect to the moveable element 22 causes a body lock ring 44 to ratchet across a mating profile on the moveable element 22. The mating profile is generally undetectable in the figures, but it can be provided as machined grooves or threads in the element 22. This movement is depicted in FIGS. 3C, 4C, 5C. The downward movement of the moveable element 22 causes the body lock ring 44 to ratchet along the mating profile of movable element 22 which is designed to retain the body lock ring 44. This retains compression on the upper element and prevents the housing 24 from moving back to its original position, keeping the upper element 12 compressed and maintaining space 42. The transition between FIGS. 3C-5C show the creation of this space 42 due to movement of the housing 24.

The applied pressure between piston 20 and piston 22 continues to push the movable element 22 downward. This applied force is transferred through the moveable element 22 in order to shear the third shear mechanism 46, shown in FIG. 5D. More specifically, the applied force is transferred through the moveable element 22, down through fifth shear mechanism 70 in housing 71 which is threadingly engaged to the lower packer element mandrel 57, down through lower packer element mandrel 57, through the fourth shear mechanism 52, and to the lower element retainer 54, which is threadingly engaged to the first wedge extension 49, which shears the third shear mechanism 46. As previously discussed, because the shear elements are set to shear at different shear strengths, the applied pressure on the fourth and fifth shear mechanism 52, 70 does not cause them to shear at this point in the process.

Shearing of the third shear mechanism 46 allows setting of the slip system 34, as shown in FIGS. 3D-5D. The slip system 34 may be activated so that it engages and grips the wellbore casing 18, typically at a location that is downhole of the lower packer element 14. Engagement of the slip system 34 anchors the testable isolation packer 10 in place.

The shearing action of the third shear mechanism 46 releases a first wedge 48 with respect to a lower mandrel 56. A second body lock ring 58 is positioned between the first wedge 48 and the lower mandrel 56. Movement of the first wedge 48 with respect to the lower mandrel 56 causes the second body lock ring 58 to ratchet over a profile cut on top of lower mandrel 56. (This profile may be similar to the profile described for the cooperation between moveable element 22 and body lock ring 44.) The applied force from the movable element 22 forces the first wedge 48 and the second body lock ring 58 nearer to the second wedge 50. The engagement of the body lock ring to the profile prevents movement of the first wedge 48 back its original position. First wedge 48 forces deployment of slips 32, as shown in FIG. 5D.

After the required force is applied to the slip system 34, the applied force shears the fourth shear mechanism 52. More specifically, the applied force is again transferred through the moveable element 22, down through fifth shear mechanism 70 in the shear housing 71, through the lower packer element mandrel 57, down through lower packer element mandrel 57, which shears the fourth shear mechanism 52. As previously discussed, because the shear elements are set to shear at different shear strengths, the applied pressure on the fifth shear mechanism 70 does not cause it to shear yet.

Shearing of the fourth shear mechanism 52 releases the lower packer element mandrel 57 from a lower packer element retainer 54. This release is shown in the transition between FIG. 5C and FIG. 6C. This movement begins applied compression to the lower packer element 14, expanding it outward to contact the casing. (The lower packer element 14 may have similar components as described above with respect to the upper packer element 12.) Each of the shears to the third and fourth shear mechanisms 46, 52 also continues to increase the compression of the upper packer element 12 as well.

There is now a partial set of both of the upper and lower packer elements 12, 14, meaning that the elements 12, 14 are expanded and contact the casing, but they are not fully sealed against the casing, but they are preventing fluid from flowing past the packer elements 12, 14. The slip system 34 is now set, such that various components of the testable packer 10 that push against the slip system 34 are locked into place and can no longer move.

The expansion of the upper and lower packer elements 12, 14 forms annulus space A1, as shown in FIG. 1. The fluid inside the annulus space A1 will exit through a bypass system 62, which can be used to remove fluid trapped between the elements 12, 14. The bypass system 62 provides a path for the trapped fluid to exit from the space A1 between the upper and lower packer elements 12, 14. Without a path to exit, this fluid may form a hydraulic lock in A1, preventing sealing of upper and lower packer elements 12, 14. This path is open during the starting to set process of the upper and lower packer elements 12, 14, the setting of the slip system 34, and the sealing of the upper and lower packer elements 12, 14.

As depicted in FIGS. 6C and 7C, the bypass system 62 is provided by cooperation between lower element port 67, chamber space 26, a channel 64, and release port 66. Fluid flows into the lower element port 67, into chamber space 26, and through the channel 64 while the upper and lower packer elements 12, 14 expand and as the space 42 grows.

The lower element port 67 is provided in the lower packer element mandrel 57. The lower element port 67 remains open until the moveable element 22 is released to block port 67, which is caused by the fifth shear mechanism 70 (as shown in FIG. 7(C) and as described further below). While port 67 is open, fluid may move from the annulus space A1 between the expanding packer elements 12, 14, through the lower element port 67 and into the chamber space 26. This fluid may then flow through chamber space 26 and into channel 64. Channel 64 is located between the lower packer element mandrel 57 and the inner mandrel 78. Fluid may then flow out to an annulus space downhole of the lower packer element 14 via the release port 66 in the first wedge extension 49, as shown in FIGS. 6C and 7C. The fluid is released below the lower packer element 14, into space A2, as shown in FIG. 2.

Pressure applied from the tubing continues to act on the movable element 22. The force is raised to shear the fifth shear mechanism 70. This allows the moveable element 22 to travel into the chamber space 26. Fluid in chamber space 26 exits through the bypass system channel 64 and out through the release port 66. This final shear and the consequent travel of the moveable element 22 is what activates the test mode of the testing subassembly 68.

The pressure from this shear and the travel of the moveable element 22 cause two primary events. First, it forces fluid out of the chamber 26 and closes the lower element port 67, which closes the bypass system 62. Second, it moves the testing subassembly 68 into the test mode position.

Referring to the closing of the bypass system 62, travel of moveable element 22 closes the bypass system 62 by forcing fluid out of the chamber 26 and closing the lower element port 67. The shearing of the fifth shear mechanism 70 allows moveable element 22 to travel in the direction of arrow 96. As shown in FIGS. 7B and 7C, this travels causes a proximal head 82 of the movable element 22 to abut an interior shoulder 84 of the housing 24, illustrated by FIG. 7B. FIG. 7C shows that the opposite distal end 83 of the moveable element 22 abuts the lower packer element mandrel 57. Sealing elements 81*a*, 81*b* on the moveable element 22 assist with sealing any fluid communication between the lower element port 67 and the remainder of the bypass system 62, as depicted in FIGS. 6C and 7C. FIG. 6C shows the sealing elements 81*a*, 81*b* as they are positioned prior to travel of the moveable element 22. FIG. 7C shows the sealing elements 81*a*, 81*b* as they are positioned after travel of the moveable element 22, such that they block any potential fluid flow between the lower element port 67 through the channel 64 and the release port 66.

Pressure from the fifth shear is sufficient to fully compress and set the upper and lower packer elements 12, 14. The elements 12, 14 should be fully expanded with sufficient compression that fluid cannot pass from above the upper packer element 12, nor from below the lower packer element 14. The packer elements 12, 14 are now in a position to be tested to ensure that the desired compression has been maintained and is holding.

The second event that occurs via shear of the fifth shear mechanism 70 and movement of the moveable element 22 is activation of the test mode of the testing subassembly 68. The test mode can involve movement of the moveable element 22 in order to open fluid communication between an inner port and an outer port so that pressure may be delivered from inside the completion string to the annulus space between the set packer elements. The test mode may be activated so that pressure may be delivered into the annuls space A1 to confirm whether the packer elements 12, 14 have been set properly and are maintaining the desired seal. The testing process generally includes activation of testing subassembly 68.

FIGS. 6C-7C depict the activation of the testing subassembly 68. As shown in FIG. 6C, a fifth shear mechanism 70 is provided on a shear housing 71, and secures the moveable element 22 to the shear housing 71. As shown in FIG. 7C, shearing of the fifth shear mechanism 70 allows movement of moveable element 22 in the direction shown by arrow 96.

As discussed, moveable element 22 has an outer port 74 and a sealing element 80. Any of the sealing elements 80, 81*a*, 81*b* described herein may be an o-ring or any other sealing mechanism. The moveable element 22 moves with respect to an inner mandrel 78. Inner mandrel 78 features an inner port 76. Movement of the moveable element 22 causes the outer port 74 and the sealing element 80 to travel downhole with respect to the inner port 76. FIG. 6C shows the sealing element 80 positioned in a first position prior to shearing of the fifth shear mechanism 70. In this first position, the sealing element 80 blocks flow between the outer port 74 and the inner ports 76. No flow is allowed between ports 74, 76. The testing subassembly 68 is closed.

FIG. 7C shows the sealing element 80 positioned in a second position after shearing of the fifth shear mechanism 70. In this second position, the sealing element 80 is moved downhole of the inner port 76. Travel of the sealing element 80 from the first position (between the outer port 74 and inner port 76) to the second position (downhole of the inner port 76) opens the flow path 72. A flow path 72 between the outer port 74 and the inner port 76 is exposed to allow testing of the testable isolation packer 10. The testing subassembly 68 is in test mode.

In this mode, fluid communication provided between ports 74, 76 allows pressure delivered to the completion string 16 to be directed to the annulus space between the set packer elements. Flow path 72 extends from inside the completion string 16 to the annulus space between the packer elements 12, 14. FIG. 2 shows a schematic of this flow path 72, and illustrates how pressure can follow this flow path 72 to the annulus space A1.

The flow path 72 of the testing subassembly 68 may be operative once the upper and lower packer elements 12, 14 have been set. It is generally undesirable to conduct pressure testing between the packer elements before they have set fully. For example, attempted methods for testing isolation packers have used rupture discs that rupture at the end of the setting of the isolation packer. One problem with rupture discs is that the rupture/burst disc will burst at a set pressure. This means that a disc may burst even if the lower packer element has not yet set. It is desirable to provide a system that allows testing of the isolation packers only after the packers have been completely deployed and sealed. Additionally, current testing systems may permit pressure to be trapped between two packer elements during the setting process. Trapping pressure can increase pressure between the elements and cause them to prematurely activate the rupture disc.

As discussed, in order to ensure that the testing subassembly 68 is only in test mode once the upper and lower packer elements 12, 14 have been set, the order of the shearing of the shearing mechanisms is configured so that they shear at different forces helps ensure that the proper setting steps are completed in order. In other words, the first shear mechanism 36 has a lower shear strength than the second shear mechanism 38. The second shear mechanism 38 has a lower shear strength than the fourth shear mechanism 46. The fourth shear mechanism 46 has a lower shear strength than the fifth shear mechanism 70.

In the specific aspects described, the moveable element 22 does not begin to open the testing subassembly until the fifth shear mechanism 70 has sheared and the packer elements have been compressed and sealed. Additional sealing elements 81*a*, 81*b* seal any potential fluid communication with the bypass system 62. Thus, a closed pressure system is now maintained in the area A1 between the upper and lower packer elements 12, 14 due to the fluid flow 72 allowed between the ports 74, 76.

Figure 8:
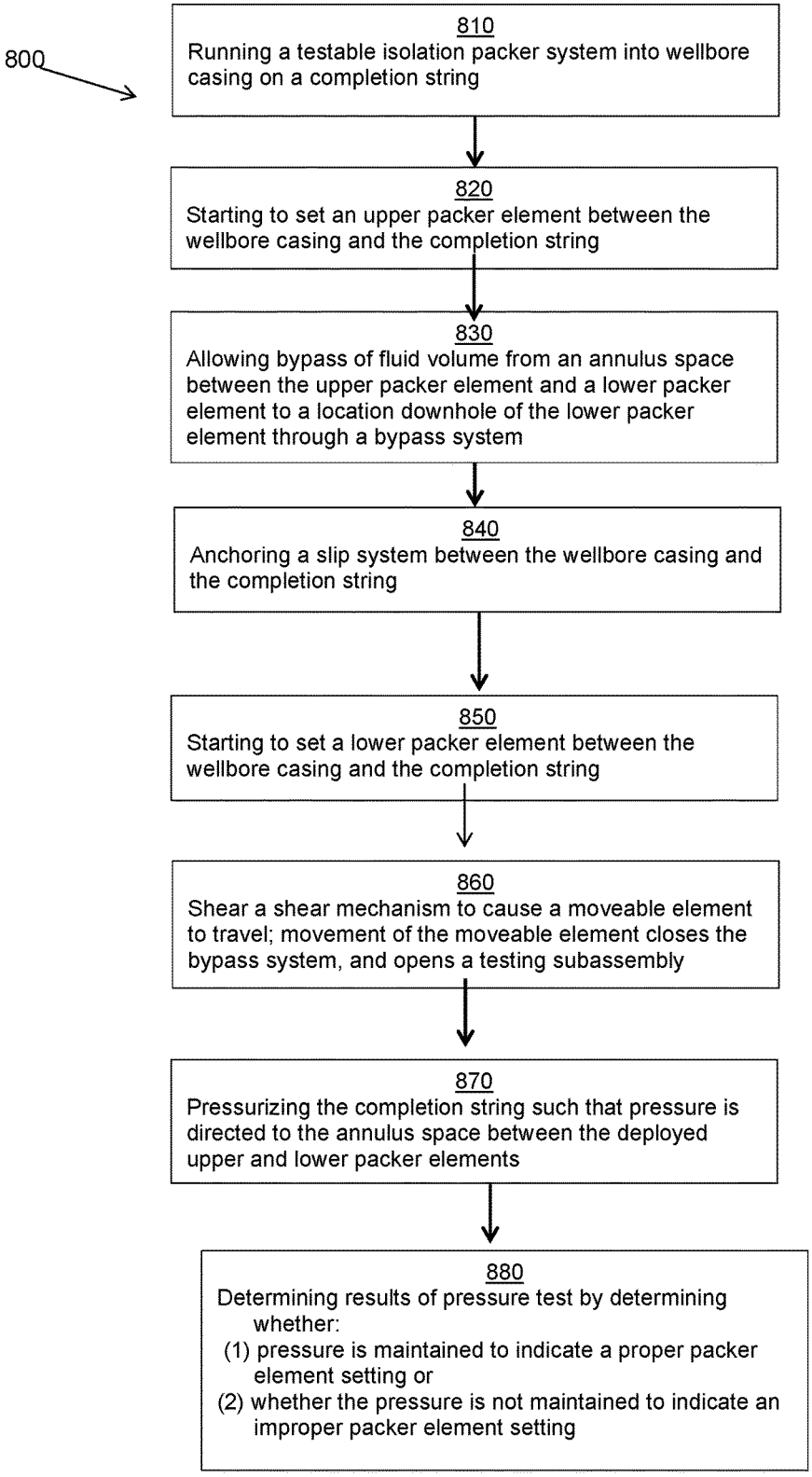
FIG. 8 provides a flow chart for one aspect of setting the testable isolation and then delivering pressure to test the packer according to one example.

The pressure testing process used for determining that the upper and lower packer elements 12, 14 have been properly compressed, sealed and set may now take place. An exemplary method 800 for setting the packer and conducting the testing steps is shown in the flowchart of FIG. 8.

The method 800 can involve running a testable isolation packer system into a wellbore casing on a completion string, as depicted in block 810. Multiple testable isolation packers may be positioned along a single completion string and run into the well at the same time.

The method 800 can also involve starting to set an upper packer element between the wellbore casing and the completion string, as depicted in block 820. The method 800 can also involve allowing bypass of fluid volume from an annulus space between the upper packer element and a lower packer element to a location downhole of the lower packer element through a bypass system, as depicted in block 830.

The method 800 can further involve anchoring a slip system, as depicted in block 840. The slip system is provided to secure the completion string in place in the wellbore. The method 800 can further involved starting to set a lower packer element between the wellbore casing and the completion string, as depicted in block 850. The upper and lower packer elements are provided to fluidly seal an annulus space between the packer elements. The expansion of the upper and lower packer elements displaces a volume of fluid during the setting process while the elements are being compressed and deployed. This volume of fluid is allowed to exit via the bypass system of block 830.

Once the displaced fluid has exited, the method 800 can also involve shearing a shear mechanism to cause a moveable element to close the bypass system, and opens a testing subassembly, as depicted in block 860. Opening of the testing subassembly creates a flow path from a space inside the completion string tubing to a space in the annulus space between the upper and lower packer elements.

Once this flow path is created, the method 800 can also involve pressurizing the completion string such that pressure is directed to the annulus space between the deployed upper and lower packer elements, as depicted in block 870. This creates a pressure test.

The method 800 can then involve determining results of the pressure test by determining whether: (1) pressure is maintained to indicate a proper packer element setting or (2) whether the pressure is not maintained to indicate an improper packer element setting, as depicted in block 880.

An operator may deliver pressure to the completion string 16 from the surface. In the test mode, pressure can travel into the inner port 76 and through the outer port 64 to the space A1 between the set packer elements 12, 14. Once a certain pressure is reached, the operator would expect the pressure to equalize, flat line, or otherwise remain generally constant. This indicates to the operator that the packer elements 12, 14 have been set properly. This is generally because the testing subassembly 68 forces the pressure into the annulus space A1.

Properly expanded and compressed packer elements 12, 14 should not allow the pressure to escape uphole or downhole past either of the packer elements 12, 14. However, if the pressure drops, bleeds, tapers, or is otherwise not generally constant, this indicates to the operator that the packer elements 12, 14 have not been set properly. The feature of providing a testing subassembly 68 can be particularly useful in multi-zone completions, where multiple packer elements are set all at once and there is no other way for the operator to know if all of the packer elements have set properly. Once all of the packer elements on the completion string have been set, an operator may pressure up individual sections in order to test specific set elements.

Referring back to FIGS. 6A and 7A, shearing of a final sixth shear mechanism 90 causes movement of an upper shifting sleeve 88. This releases the upper load lugs 92 (which are engaged to a profile 301 on a mandrel 94 during run-in), disengaging the profile 301 on the mandrel 94, as shown in FIG. 7A. This final shear is generally at the highest pressure so that it occurs last. This final shear is intended to take place only after the pressure testing of the set packer elements 12, 14 occurs. Shearing of sixth shear mechanism 90 is conducted so that the packer 10 can be removed from the well, when desired. In use, after the packer elements 12, 14 have been tested, the operator can pressure up to cause shear mechanism 90 to shear. This final shear allows the operator to pull the tension through mandrel 94 and mandrel 303, to the release mechanism at the bottom to the packer 330. The general purpose of the top assembly components shown in FIGS. 6A and 7A is to mechanically lock out the release mechanism 330 of the testable isolation packer 10 during the installation process. The packer 10 is designed and required to carry a great deal of weight for installing equipment in the wellbore. The weight of the equipment applies tension to the mandrels. The packer is released by tension on the mandrels, so a lock out feature is needed to prevent the weight of the completion equipment from activating the release mechanism. Once the packer elements 12, 14 have been set and tested, the lock out feature can be disabled so that the packer can be retrieved in the future. This can allow the operator, at a later date, the retrieve the packer with tension.

Figure 6D:
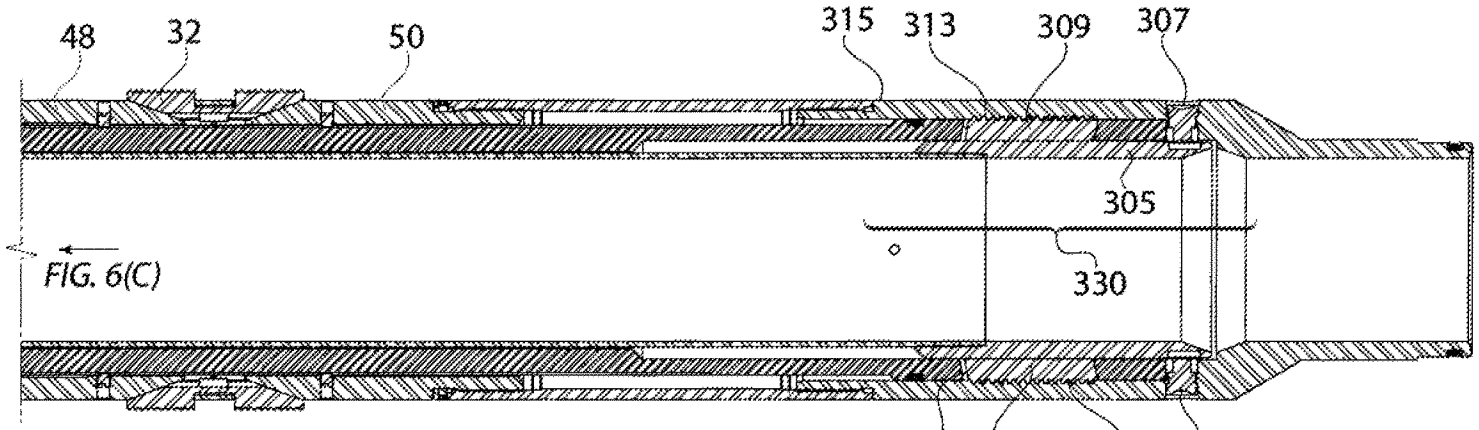
Figure 7D:
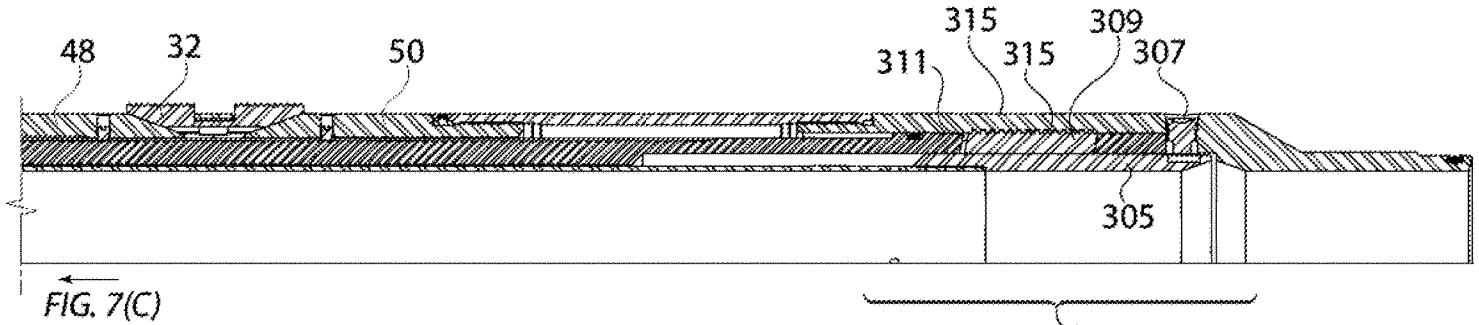

The packer is retrieved by pulling tension on mandrel 94 and mandrel 303 as shown in FIGS. 6A, 7A, 6B, and 7B, as well as on prop 305 as shown in FIGS. 6D and 7D, in order to shear large pins 307. The pins 307 shear and the prop 305 travels upwards to unprop the dogs 309 in window 311 on mandrel 56. Once the dogs 309 are unsupported, they disengage from profile 313 in bottom sub 315. Tension on mandrel 94 will then pull the mandrel 78 and body lock ring 58 and upper wedge 48 out from under slip 32 to release the packer.

The foregoing description, including illustrated aspects and examples, has been presented only for the purpose of illustration and description and is not intended to be exhaustive or to limiting to the precise forms disclosed. Numerous modifications, adaptations, and uses thereof will be apparent to those skilled in the art without departing from the scope of this disclosure.

What is claimed is:

1. A testable isolation packer system for use in a wellbore along a completion string, comprising:

(a) upper and lower packer elements;

(b) a bypass system, comprising (i) a lower element port in fluid communication with a space between the upper and lower packer elements, (ii) a release port for releasing fluid to a space downhole of the lower packer element, and (iii) a channel for directing fluid from the lower element port to the release port, wherein when the bypass system is in by-pass mode, fluid trapped between the upper and lower packer elements enters the lower element port, travels through the channel, and exits at the release port downhole of the lower packer element;

(c) a testing, subassembly comprising a flow path extending from inside of the completion string to the space between the upper and lower packers elements, the flow path controlled by an external moveable element positioned circumferentially around an inner mandrel, the external movable element comprising (i) an outer port in fluid communication with the space between the upper and lower packer elements and (ii) a sealing element, wherein the moveable element is moveable with respect to the inner mandrel, wherein the inner mandrel comprises an inner port that is in fluid communication with the inside of the completion string, wherein movement of the external moveable element moves the outer port and the sealing element uphole or downhole relative to the inner port, wherein when the testing subassembly is in a non-test mode, the outer port is positioned on a first side of the inner port and the flow path is closed via the sealing element, and wherein when the testing subassembly is in a test mode, movement of the external movable element causes the outer port of and the sealing element to move past the inner port, opening the flow path.

2. The system of claim 1, wherein the sealing element comprises a two position sealing element, with a first position that blocks the flow path between the inner port and the outer port and a second position that permits fluid flow between the inner port and the outer port.

3. The system of claim 1, wherein the bypass system further comprises a chamber fluidly connecting the lower element port to the channel.

4. The system of claim 1, further comprising a shear mechanism, the shearing of which allows travel of the sealing element to close the lower element port of the bypass system and to open the testing subassembly, wherein the shear mechanism prevents activation of the testing subassembly until the upper and lower packer elements are fully set.

5. The system of claim 1, wherein the testable isolation packer is run into the wellbore on the completion string, and wherein the sealing element is positioned between the outer port and the inner port to block the flow path from inside the completion string to a wellbore space between the upper and lower packer elements.

6. The system of claim 1, wherein the testing subassembly is closed when the bypass system is open, and wherein the bypass system closes when the testing subassembly opens.

7. The system of claim 1, wherein the lower element port of the bypass system remains open until a shear mechanism is sheared and causes the movable element to block the lower element port.

8. The system of claim 1, further comprising (1) an upper packer element setting system comprising a piston, a housing, and one or more shear mechanisms to allow movement of the piston and housing, and (2) a lower packer element setting system comprising a lower packer element mandrel, a lower packer retainer, and a shear mechanism to allow movement of the lower packer element mandrel.

9. The system of claim 1, further comprising a slip system setting system comprising a first wedge, a second wedge, a slip, and a shear mechanism to release movement of the first wedge to set the slip.

10. A testable isolation packer system for use along a completion string, comprising:

(a) upper and lower packer elements comprising a space therebetween;

(b) a selectively operable testing subassembly positioned between the upper and lower packer elements, the testing subassembly comprising an inner mandrel have a flow path extending from inside of the completion string defined by an inner port to the space between the upper and lower packer elements, the flow path controlled by an external movable element positioned circumferentially around the inner mandrel, the external moveable element comprising an outer port and a sealing element, wherein movement of the external movable element moves the outer port and the sealing element uphole or downhole with respect to the inner port, wherein movement of the external moveable element to a test mode opens a fluid path between the outer port and the inner port via movement of the sealing element and the outer port past the inner port, the flow path configured to be maintained in a closed mode until the upper and lower packer elements have been set; and (c) a bypass system positioned between the lower packer element and a slip system, the bypass system configured to be maintained in an open position until the testing subassembly is opened.

11. The system of claim 10, further comprising a shear mechanism, the shearing of which releases movement of the moveable element to close the bypass system and to open the testing subassembly.

12. The system of claim 10, further comprising a plurality of shear mechanisms, each of which is set to shear at different forces of increasing compression in order to release one or more components that set the upper and lower packers, to release one or more components that set the slip system, and to release one or more components that close the bypass system and open the testing subassembly in a certain order.

* * * * *